US008672654B2

(12) United States Patent
Beagle et al.

(10) Patent No.: US 8,672,654 B2
(45) **Date of Patent: *Mar. 18, 2014**

(54) SHAFT MOUNTED COUNTERWEIGHT, METHOD AND SCROLL COMPRESSOR INCORPORATING SAME

(75) Inventors: Wayne P. Beagle, Chittenango, NY (US); James W. Bush, Skaneateles, NY (US); Jason K. Torrisi, Cicero, NY (US)

(73) Assignee: Bitzer Kuhlmaschinenbau GmbH, Sindelfingen (DE)

( * ) Notice: Subject to any disclaimer, the term of this patent is extended or adjusted under 35 U.S.C. 154(b) by 111 days.

This patent is subject to a terminal disclaimer.

(21) Appl. No.: 13/109,355

(22) Filed: May 17, 2011

(65) Prior Publication Data

US 2011/0217198 A1 Sep. 8, 2011

Related U.S. Application Data

(63) Continuation of application No. 12/015,689, filed on Jan. 17, 2008, now Pat. No. 7,967,581.

(51) Int. Cl.

| | |
|---|---|
| ***F01C 1/02*** | (2006.01) |
| ***F04C 2/02*** | (2006.01) |
| ***F04C 18/02*** | (2006.01) |
| ***F01C 1/063*** | (2006.01) |
| ***F04C 2/063*** | (2006.01) |
| ***F04C 18/063*** | (2006.01) |

(52) U.S. Cl.
USPC ..... 418/55.1; 74/589; 74/603; 29/888.022; 29/888.08

(58) Field of Classification Search
USPC ..... 418/55.3, 55.1, 55.2, 55.6, 86, 151; 74/589, 603; 403/383; 29/888.022, 29/888.08, 447
See application file for complete search history.

(56) References Cited

U.S. PATENT DOCUMENTS

| | | | |
|---|---|---|---|
| 4,655,696 | A | 4/1987 | Utter |
| 4,696,630 | A | 9/1987 | Sakata et al. |
| 4,927,339 | A | 5/1990 | Riffe et al. |
| 5,033,945 | A | 7/1991 | Kolb |
| 5,090,878 | A | 2/1992 | Haller |
| 5,247,736 | A | 9/1993 | Fraser, Jr. et al. |
| 5,320,506 | A | 6/1994 | Fogt |
| 5,362,218 | A | 11/1994 | Fukanuma et al. |
| 5,366,360 | A | 11/1994 | Bookbinder et al. |
| 5,427,511 | A | 6/1995 | Caillat et al. |
| 5,582,312 | A | 12/1996 | Niles et al. |
| 6,174,149 | B1 | 1/2001 | Bush |
| 6,227,830 | B1 | 5/2001 | Fields et al. |
| 6,398,530 | B1 | 6/2002 | Hasemann |

(Continued)

FOREIGN PATENT DOCUMENTS

| | | |
|---|---|---|
| EP | 0 924 432 A1 | 6/1999 |
| JP | 02-195011 | 8/1990 |
| JP | 2003-161271 | 6/2003 |

*Primary Examiner* — Mary A Davis
(74) *Attorney, Agent, or Firm* — Reinhart Boerner Van Deuren P.C.

(57) ABSTRACT

A counterweight mounted to a drive shaft in a scroll compressor is provided. The drive shaft has a central annular segment generally concentric about the central axis and an eccentric annular segment offset from the central axis that can be used for driving the movable scroll compressor body. A counterweight engages the eccentric and also engages the annular segment for location and mounting of the counterweight to the shaft.

10 Claims, 7 Drawing Sheets

(56) References Cited

U.S. PATENT DOCUMENTS

| | | | | |
|---|---|---|---|---|
| 6,439,867 | B1 | 8/2002 | Clendenin | |
| 6,488,489 | B2 | 12/2002 | Williams et al. | |
| 6,682,327 | B2 | 1/2004 | Milliff et al. | |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,112,046 | B2 | 9/2006 | Kammhoff et al. | |
| 7,163,383 | B2 | 1/2007 | Skinner | |
| 7,878,775 | B2 | 2/2011 | Duppert et al. | |
| 7,878,780 | B2 | 2/2011 | Bush et al. | |
| 7,918,658 | B2 | 4/2011 | Bush et al. | |
| 7,967,581 | B2 * | 6/2011 | Beagle et al. | 418/55.1 |
| 2001/0013271 | A1 * | 8/2001 | Fujii et al. | 91/499 |
| 2009/0185921 | A1 | 7/2009 | Beagle et al. | |
| 2009/0185926 | A1 | 7/2009 | Bush | |
| 2009/0185927 | A1 | 7/2009 | Duppert et al. | |
| 2009/0185929 | A1 | 7/2009 | Duppert et al. | |
| 2009/0185931 | A1 | 7/2009 | Beagle et al. | |
| 2009/0185932 | A1 | 7/2009 | Beagle et al. | |
| 2009/0185934 | A1 | 7/2009 | Bush | |

* cited by examiner

SHAFT MOUNTED COUNTERWEIGHT, METHOD AND SCROLL COMPRESSOR INCORPORATING SAME

CROSS-REFERENCE TO RELATED PATENT APPLICATIONS

This patent application is a Continuation of co-pending U.S. patent application Ser. No. 12/015,689, filed Jan. 17, 2008, the entire teachings and disclosure of which are incorporated herein by reference thereto.

FIELD OF THE INVENTION

The present invention relates to counterweights which are mounted on shafts and/or scroll compressor assemblies incorporating the same.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors conventionally include an outer housing having a scroll compressor contained therein. A scroll compressor includes first and second scroll compressor members. A first compressor member is typically arranged stationary and fixed in the outer housing. A second scroll compressor member is moveable relative to the first scroll compressor member in order to compress refrigerant between respective scroll ribs which rise above the respective bases and engage in one another. Conventionally the moveable scroll compressor member is driven about an orbital path about a central axis for the purposes of compressing refrigerant. An appropriate drive unit, typically an electric motor, is provided usually within the same housing to drive the movable scroll member.

In such scroll compressor assemblies and other such equipment, counterweights are often employed to counteract the weight imbalance about the rotational axis. For example, in scroll compressors, the movable scroll compressor body and the offset eccentric section on the drive shaft create weight imbalance relative to the rotational axis. As a result, upper and lower counterweights are often provided for balancing purposes to reduce vibration and noise of the overall assembly by internally balancing and/or cancelling out inertial forces. One difficulty associated with such counterweights is precisely locating such counterweights at a predetermined angular position to correctly counteract the weight imbalance created by the movable scroll member. Precise location of the counterweight is desirable so as to create a center of mass of the rotating components that is aligned with the central rotational axis. The present invention is directed towards improvements in mounting in location of such counterweights to drive shafts.

BRIEF SUMMARY OF THE INVENTION

One aspect of the present invention is a novel way to mount a counterweight to a shaft. Such an apparatus comprises a shaft rotatable about a central axis. The shaft has a central annular segment generally concentric about the central axis and an eccentric annular segment offset from the central axis. A counterweight engages the eccentric and also engages the annular segment for location and mounting of the counterweight to the shaft.

In another aspect, the invention provides a scroll compressor for compressing fluid in which different contact surfaces are provided to mount and locate a counterweight. Such a scroll compressor includes scroll compressor bodies having respective bases and respective scroll ribs that project from the respective bases and which mutually engage. A drive unit provides a rotational output on a shaft, with the shaft operatively driving one of the scroll compressor bodies to facilitate relative movement for the compression of fluid. A counterweight is mounted to the shaft. The counterweight has (a) a first shaft contact surface defined about a first axis coacting with the shaft; and (b) a second shaft contact surface defined about a second axis different than the first axis coacting with the shaft.

In another aspect, the invention provides a method of mounting a counterweight to a shaft in a scroll compressor assembly. The method comprises: thermally differentiating a shaft and a counterweight to facilitate assembly, wherein the shaft has annular segments including a central annular segment generally concentric about a central axis and an eccentric annular segment offset from the central axis; assembling the counterweight with the shaft; locating the counterweight on a first one of the annular segments; relieving the thermal differentiation to lock the counterweight on a second one of the annular segments. Alternatively, in another embodiment it is also possible that the counterweight may be pressed onto the shaft without benefit of thermal differentiation. While substantial axial pressing force can be used instead of thermal differentiation, thermal differentiation is a more preferred embodiment so as to avoid the need for such pressing force.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
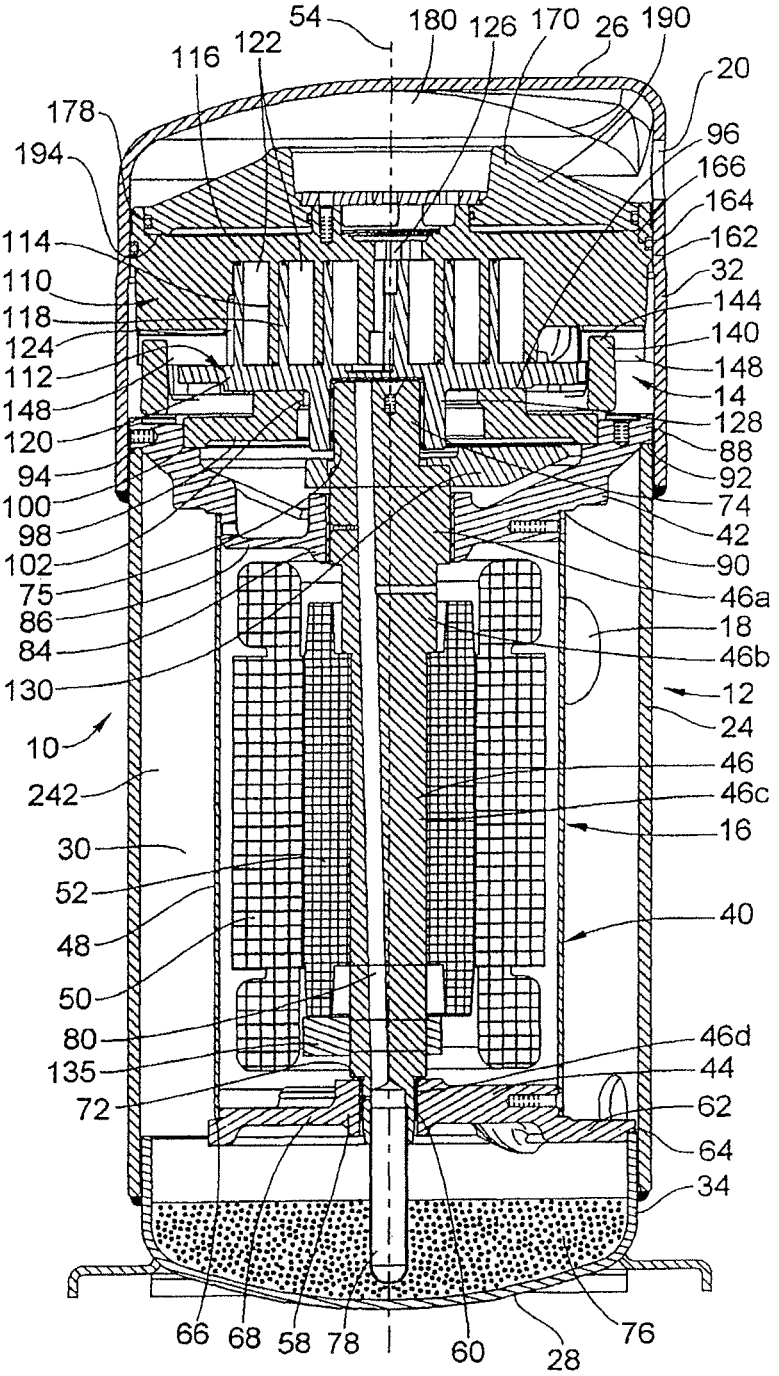
FIG. 1 is a cross section of a scroll compressor assembly in accordance with an embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high pressure state.

The outer housing 12 may take many forms. In the preferred embodiment, the outer housing includes multiple shell sections and preferably three shell sections to include a central cylindrical housing section 24, a top end housing section 26 and a bottom end housing section 28. Preferably, the housing sections 24, 26, 28 are formed of appropriate sheet steel and welded together to make a permanent outer housing 12 enclosure. However, if disassembly of the housing is desired, other housing provisions can be made that can include metal castings or machined components.

The central housing section 24 is preferably cylindrical and telescopically interfits with the top and bottom end housing sections 26, 28. This forms an enclosed chamber 30 for housing the scroll compressor 14 and drive unit 16. Each of the top and bottom end housing sections 26, 28 are generally dome shaped and include respective cylindrical side wall regions 32, 34 to mate with the center section 24 and provide for closing off the top and bottom ends of the outer housing 12. As can be seen in FIG. 1, the top side wall region 32 telescopically overlaps the central housing section 24 and is exteriorly welded along a circular welded region to the top end of the central housing section 24. Similarly the bottom side wall region 34 of the bottom end housing section 28 telescopically interfits with the central housing section 24 (but is shown as being installed into the interior rather than the exterior of the central housing section 24) and is exteriorly welded by a circular weld region.

The drive unit 16 may preferably take the form of an electrical motor assembly 40, which is supported by upper and lower bearing members 42, 44. The motor assembly 40 operably rotates and drives a shaft 46. The electrical motor assembly 40 generally includes an outer annular motor housing 48, a stator 50 comprising electrical coils and a rotor 52 that is coupled to the drive shaft 46 for rotation together. Energizing the stator 50 is operative to rotatably drive the rotor 52 and thereby rotate the drive shaft 46 about a central axis 54.

Figure 4:
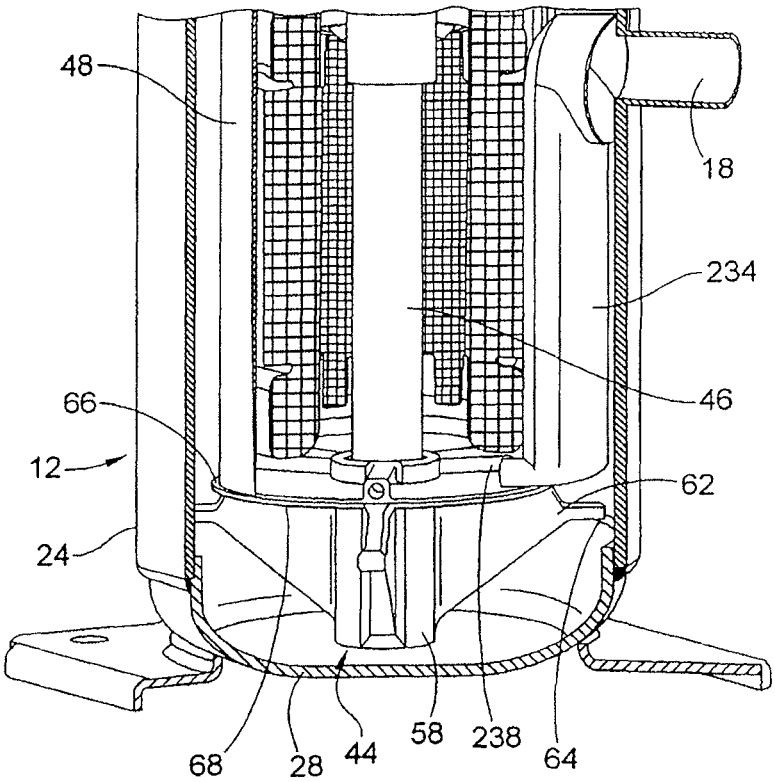
FIG. 4 is a partial cross section and cut-away view of a lower portion of the embodiment of FIG. 1.

With reference to FIGS. 1 and 4, the lower bearing member 44 includes a central generally cylindrical hub 58 that includes a central bushing and opening to provide a cylindrical bearing 60 to which the drive shaft 46 is journaled for rotational support. A plurality of arms 62 and typically at least three arms project radially outward from the bearing central hub 58 preferably at equally spaced angular intervals. These support arms 62 engage and are seated on a circular seating surface 64 provided by the terminating circular edge of the bottom side wall region 34 of the bottom outer housing section 28. As such, the bottom housing section 28 can serve to locate, support and seat the lower bearing member 44 and thereby serves as a base upon which the internal components of the scroll compressor assembly can be supported.

The lower bearing member 44 in turn supports the cylindrical motor housing 48 by virtue of a circular seat 66 formed on a plate-like ledge region 68 of the lower bearing member 44 that projects outward along the top of the central hub 58. The support arms 62 also preferably are closely toleranced relative to the inner diameter of the central housing section. The arms 62 may engage with the inner diameter surface of the central housing section 24 to centrally locate the lower bearing member 44 and thereby maintain position of the central axis 54. This can be by way of an interference and press-fit support arrangement between the lower bearing member 44 and the outer housing 12 (See e.g. FIG. 4). Alternatively according to a more preferred configuration, as shown in FIG. 1, the lower bearing engages with the lower housing section 28 which is in turn attached to center section 24. Likewise, the outer motor housing 48 may be supported with an interference and press-fit along the stepped seat 66 of the lower bearing member 44. As shown, screws may be used to securely fasten the motor housing to the lower bearing member 44.

The drive shaft 46 is formed with a plurality of progressively smaller diameter sections **46*a*-46*d* which are aligned concentric with the central axis 54. The smallest diameter section 46*d* is journaled for rotation within the lower bearing member 44 with the next smallest section 46*c* providing a step 72 for axial support of the drive shaft 46 upon the lower bearing member 44. The largest section 46*a* is journaled for rotation within the upper bearing member 42**.

The drive shaft 46 further includes an offset eccentric drive section 74 that has a cylindrical drive surface 75 about an offset axis that is offset relative to the central axis 54. This offset drive section 74 is journaled within a cavity of the movable scroll member of the scroll compressor 14 to drive the movable member of the scroll compressor about an orbital path when the drive shaft 46 is spun about the central axis 54. To provide for lubrication of all of these bearing surfaces, the outer housing 12 provides an oil lubricant sump 76 at the bottom end in which suitable oil lubricant is provided. The drive shaft 46 has an oil lubricant pipe and impeller 78 that acts as an oil pump when the drive shaft is spun and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 includes various radial passages as shown to feed oil through centrifugal force to appropriate bearing surfaces and thereby lubricate sliding surfaces as may be desired.

The upper bearing member 42 includes a central bearing hub 84 into which the largest section 46*a* of the drive shaft 46 is journaled for rotation. Extending outward from the bearing hub 84 is a support web 86 that merges into an outer peripheral support rim 88. Provided along the support web 86 is an annular stepped seating surface 90 which may have an interference and press-fit with the top end of the cylindrical motor housing 48 to thereby provide for axial and radial location. The motor housing 48 may also be fastened with screws to the upper bearing member 42. The outer peripheral support rim 88 also may include an outer annular stepped seating surface 92 which may have an interference and press-fit with the outer housing 12. For example, the outer peripheral rim 88 can engage the seating surface 92 axially, that is it engages on a lateral plane perpendicular to axis 54 and not through a diameter. To provide for centering there is provided a diametric fit just below the surface 92 between the central housing section 24 and the support rim 88. Specifically, between the telescoped central and top-end housing sections 24, 26 is defined in internal circular step 94, which is located axially and radially with the outer annular step 92 of the upper bearing member 42.

The upper bearing member 42 also provides axial thrust support to the movable scroll member through a bearing support via an axial thrust surface 96. While this may be integrally provided by a single unitary component, it is shown as being provided by a separate collar member 98 that is interfit with the upper portion of the upper bearing member 42 along stepped annular interface 100. The collar member 98 defines a central opening 102 that is a size large enough to provide for receipt of the eccentric offset drive section 74 and allow for orbital eccentric movement thereof that is provided within a receiving portion of the movable scroll compressor member 112.

Turning in greater detail to the scroll compressor 14, the scroll compressor body is provided by first and second scroll compressor bodies which preferably include a stationary fixed scroll compressor body 110 and a movable scroll compressor body 112. The moveable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the second movable scroll compressor body 112 includes a second scroll rib 118 projecting axially from a plate-like base 120 and is in the design form of a similar spiral. The scroll ribs 114, 118 engage in one another and abut sealingly on the respective base surfaces 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 2-3). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor.

The movable scroll compressor body 112 engages the eccentric offset drive section 74 of the drive shaft 46. More specifically, the receiving portion of the movable scroll compressor body 112 includes a cylindrical bushing drive hub 128 which slideably receives the eccentric offset drive section 74 with a slideable bearing surface provided therein. In detail, the eccentric offset drive section 74 engages the cylindrical drive hub 128 in order to move the moveable scroll compressor body 112 about an orbital path about the central axis 54 during rotation of the drive shaft 46 about the central axis 54. Considering that this offset relationship causes a weight imbalance relative to the central axis 54, the assembly preferably includes a counter weight 130 that is mounted at a fixed angular orientation to the drive shaft 46. The counter weight 130 acts to offset the weight imbalance caused by the eccentric offset drive section 74 and the movable scroll compressor body 112 that is driven about an orbital path (e.g. among other things, the scroll rib is not equally balanced). The counter weight 130 includes an attachment collar 132 and an offset weight region 134 (see counter weight shown best in FIG. 2) that provides for the counter weight effect and thereby balancing of the overall weight of the rotating components about the central axis 54 in cooperation with a lower counterweight 135 for balancing purposes. This provides for reduced vibration and noise of the overall assembly by internally balancing or cancelling out inertial forces.

Figure 2:
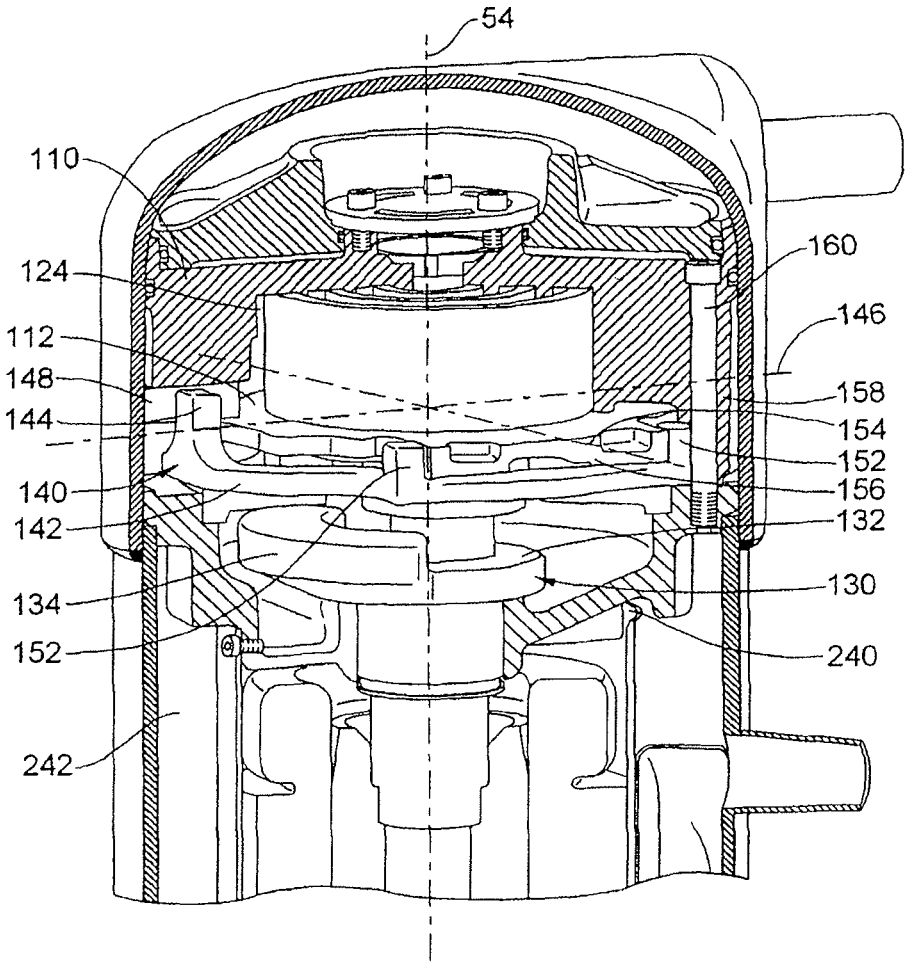
FIG. 2 is a partial cross section and cut-away view of an isometric drawing of an upper portion of the scroll compressor embodiment shown in FIG. 1.
Figure 3:
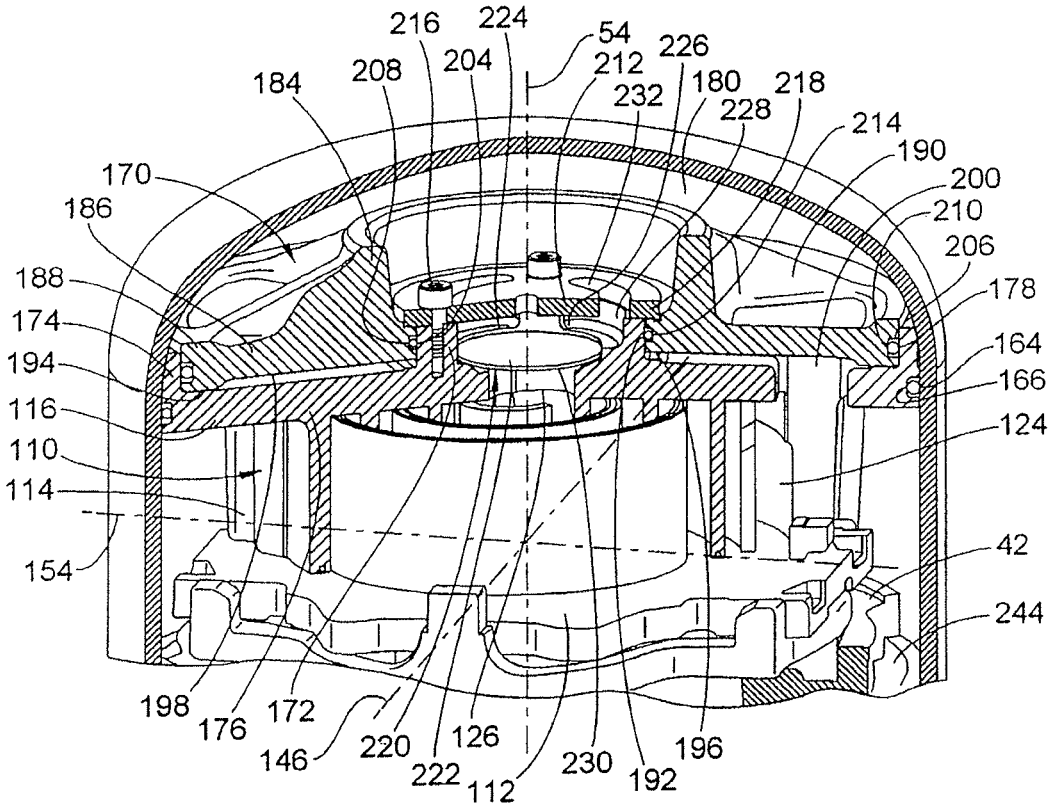
FIG. 3 is a similar view to FIG. 2 but enlarged and taken about a different angle and section in order to show other structural features.

With reference to FIGS. 1-3, and particularly FIG. 2, the guiding movement of the scroll compressor can be seen. To guide the orbital movement of the movable scroll compressor body 112 relative to the fixed scroll compressor body 110, an appropriate key coupling 140 may be provided. Keyed couplings are often referred to in the scroll compressor art as an "Oldham Coupling." In this embodiment, the key coupling 140 includes an outer ring body 142 and includes two first keys 144 that are linearly spaced along a first lateral axis 146 and that slide closely and linearly within two respective keyway tracks 148 that are linearly spaced and aligned along the first axis 146 as well. The key way tracks 148 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project from the ring body 142 of the key coupling 140. This control of movement over the first lateral axis 146 guides part of the overall orbital path of the moveable scroll compressor body 112.

Additionally, the key coupling includes four second keys 152 in which opposed pairs of the second keys 152 are linearly aligned substantially parallel relative to a second traverse lateral axis 154 that is perpendicular to the first lateral axis 146. There are two sets of the second keys 152 that act cooperatively to receive projecting sliding guide portions 156 that project from the base 120 on opposite sides of the movable scroll compressor body 112. The guide portions 156 linearly engage and are guided for linear movement along the second traverse lateral axis by virtue of sliding linear guiding movement of the guide portions 156 along sets of the second keys 152.

By virtue of the key coupling 140, the moveable scroll compressor body 112 has movement restrained relative to the fixed scroll compressor body 110 along the first lateral axis 146 and second traverse lateral axis 154. This results in the prevention of any relative rotation of the moveable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the moveable scroll 112 along the first lateral axis 146 therewith. Additionally, the movable scroll compressor body can independently move relative to the key coupling 140 along the second traverse lateral axis 154 by virtue of relative sliding movement afforded by the guide portions 156 which are received and slide between the second keys 152. By allowing for simultaneous movement in two mutually perpendicular axes 146, 154, the eccentric motion that is afforded by the eccentric offset drive section 74 of the drive shaft 46 upon the cylindrical drive hub 128 of the movable scroll compressor body 112 is translated into an orbital path movement of the movable scroll compressor body 112 relative to the fixed scroll compressor body 110.

Referring in greater detail to the fixed scroll compressor body 110, this body 110 is fixed to the upper bearing member 42 by an extension extending axially and vertically therebetween and around the outside of the moveable scroll compressor body 112. In the illustrated embodiment, the fixed scroll compressor body 110 includes a plurality of axially projecting legs 158 (see FIG. 2) projecting on the same side as the scroll rib from the base 116. These legs 158 engage and are seated against the top side of the upper bearing member 42. Preferably, bolts 160 (FIG. 2) are provided to fasten the fixed scroll compressor body 110 to the upper bearing member 42. The bolts 160 extend axially through the legs 158 of the fixed scroll compressor body and are fastened and screwed into corresponding threaded openings in the upper bearing member 42. For further support and fixation of the fixed scroll compressor body 110, the outer periphery of the fixed scroll compressor body includes a cylindrical surface 162 that is closely received against the inner cylindrical surface of the outer housing 10 and more particularly the top end housing section 26. A clearance gap between surface 162 and side wall 32 serves to permit assembly of upper housing 26 over the compressor assembly and subsequently to contain the o-ring seal 164. An O-ring seal 164 seals the region between the cylindrical locating surface 162 and the outer housing 112 to prevent a leak path from compressed high pressure fluid to the uncompressed section/sump region inside of the outer housing 12. The seal 164 can be retained in a radially outward facing annular groove 166.

With reference to FIGS. 1-3 and particularly FIG. 3, the upper side (e.g. the side opposite the scroll rib) of the fixed scroll 110 supports a floatable baffle member 170. To accommodate the same, the upper side of the fixed scroll compressor body 110 includes an annular and more specifically cylindrical inner hub region 172 and an outwardly spaced peripheral rim 174 which are connected by radially extending disc region 176 of the base 116. Between the hub 172 and the rim 174 is provided an annular piston-like chamber 178 into which the baffle member 170 is received. With this arrangement, the combination of the baffle member 170 and the fixed scroll compressor body 110 serve to separate a high pressure chamber 180 from lower pressure regions within the housing 10. While the baffle member 170 is shown as engaging and constrained radially within the outer peripheral rim 174 of the fixed scroll compressor body 110, the baffle member 170 could alternatively be cylindrically located against the inner surface of the outer housing 12 directly.

As shown in the embodiment, and with particular reference to FIG. 3, the baffle member 170 includes an inner hub region 184, a disc region 186 and an outer peripheral rim region 188. To provide strengthening, a plurality of radially extending ribs 190 extending along the top side of the disc region 186 between the hub region 184 and the peripheral rim region 188 may be integrally provided and are preferably equally angularly spaced relative to the central axis 54. The baffle member 170 in addition to tending to separate the high pressure chamber 180 from the remainder of the outer housing 12 also serves to transfer pressure loads generated by high pressure chamber 180 away from the inner region of the fixed scroll compressor body 110 and toward the outer peripheral region of the fixed scroll compressor body 110. At the outer peripheral region, pressure loads can be transferred to and carried more directly by the outer housing 12 and therefore avoid or at least minimize stressing components and substantially avoid deformation or deflection in working components such as the scroll bodies. Preferably, the baffle member 170 is floatable relative to the fixed scroll compressor body 110 along the inner peripheral region. This can be accomplished, for example, as shown in the illustrated embodiment by a sliding cylindrical interface 192 between mutually cylindrical sliding surfaces of the fixed scroll compressor body and the baffle member along the respective hub regions thereof. As compressed high pressure refrigerant in the high pressure chamber 180 acts upon the baffle member 170, substantially no load may be transferred along the inner region, other than as may be due to frictional engagement. Instead, an axial contact interface ring 194 is provided at the radial outer periphery where the respective rim regions are located for the fixed scroll compressor body 110 and the baffle member 170. Preferably, an annular axial gap 196 is provided between the innermost diameter of the baffle member 170 and the upper side of the fixed scroll compressor body 110. The annular axial gap 196 is defined between the radially innermost portion of the baffle member and the scroll member and is adapted to decrease in size in response to a pressure load caused by high pressure refrigerant compressed within the high pressure chamber 180. The gap 196 is allowed to expand to its relaxed size upon relief of the pressure and load.

To facilitate load transfer most effectively, an annular intermediate or lower pressure chamber 198 is defined between the baffle member 170 and the fixed scroll compressor body 110. This intermediate or lower pressure chamber can be subject to either the lower sump pressure as shown, or can be subject to an intermediate pressure (e.g. through a fluid communication passage defined through the fixed scroll compressor body to connect one of the individual compression chambers 122 to the chamber 198). Load carrying characteristics can therefore be configured based on the lower or intermediate pressure that is selected for best stress/deflection management. In either event, the pressure contained in the intermediate or low pressure chamber 198 during operation is substantially less than the high pressure chamber 180 thereby causing a pressure differential and load to develop across the baffle member 170.

To prevent leakage and to better facilitate load transfer, inner and outer seals 204, 206 may be provided, both of which may be resilient, elastomeric O-ring seal members. The inner seal 204 is preferably a radial seal and disposed in a radially inwardly facing inner groove 208 defined along the inner diameter of the baffle member 170. Similarly the outer seal 206 can be disposed in a radially outwardly facing outer groove 210 defined along the outer diameter of the baffle member 170 in the peripheral rim region 188. While a radial seal is shown at the outer region, alternatively or in addition an axial seal may be provided along the axial contact interface ring 194.

While the baffle member 170 could be a stamped steel component, preferably and as illustrated, the baffle member 170 comprises a cast and/or machined member (and may be aluminum) to provide for the expanded ability to have several structural features as discussed above. By virtue of making the baffle member in this manner, heavy stamping of such baffles can be avoided.

Additionally, the baffle member 170 can be retained to the fixed scroll compressor body 110. Specifically, as can be seen in the figures, a radially inward projecting annular flange 214 of the inner hub region 184 of the baffle member 170 is trapped axially between the stop plate 212 and the fixed scroll compressor body 110. The stop plate 212 is mounted with bolts 216 to a fixed scroll compressor body 210. The stop plate 212 includes an outer ledge 218 that projects radially over the inner hub 172 of the fixed scroll compressor body 110. The stop plate ledge 218 serves as a stop and retainer for the baffle member 170. In this manner, the stop plate 212 serves to retain the baffle member 170 to the fixed scroll compressor body 110 such that the baffle member 170 is carried thereby.

As shown, the stop plate 212 can be part of a check valve 220. The check valve includes a moveable valve plate element 222 contained within a chamber defined in the outlet area of the fixed scroll compressor body within the inner hub 172. The stop plate 212 thus closes off a check valve chamber 224 in which the moveable valve plate element 222 is located. Within the check valve chamber there is provided a cylindrical guide wall surface 226 that guides the movement of the check valve 220 along the central axis 54. Recesses 228 are provided in the upper section of the guide wall 226 to allow for compressed refrigerant to pass through the check valve when the moveable valve plate element 222 is lifted off of the valve seat 230. Openings 232 are provided in the stop plate 212 to facilitate passage of compressed gas from the scroll compressor into the high pressure chamber 180. The check valve is operable to allow for one way directional flow such that when the scroll compressor is operating, compressed refrigerant is allowed to leave the scroll compressor bodies through the compression outlet 126 by virtue of the valve plate element 222 being driven off of its valve seat 230. However, once the drive unit shuts down and the scroll compressor is no longer operating, high pressure contained within the high pressure chamber 180 forces the movable valve plate element 222 back upon the valve seat 230. This closes off check valve 220 and thereby prevents backflow of compressed refrigerant back through the scroll compressor.

During operation, the scroll compressor assembly 10 is operable to receive low pressure refrigerant at the housing inlet port 18 and compress the refrigerant for delivery to the high pressure chamber 180 where it can be output through the housing outlet port 20. As is shown, in FIG. 4, an internal conduit 234 can be connected internally of the housing 12 to guide the lower pressure refrigerant from the inlet port 18 into the motor housing via a motor housing inlet 238. This allows the low pressure refrigerant to flow across the motor and thereby cool and carry heat away from the motor which can be caused by operation of the motor. Low pressure refrigerant can then pass longitudinally through the motor housing and around through void spaces therein toward the top end where it can exit through a plurality of motor housing outlets 240 (see FIG. 2) that are equally angularly spaced about the central axis 54. The motor housing outlets 240 may be defined either in the motor housing 48, the upper bearing member 42 or by a combination of the motor housing and upper bearing member (e.g. by gaps formed therebetween as shown in FIG. 2). Upon exiting the motor housing outlet 240, the low pressure refrigerant enters an annular chamber 242 formed between the motor housing and the outer housing. From there, the low pressure refrigerant can pass through the upper bearing member through a pair of opposed outer peripheral through ports 244 that are defined by recesses on opposed sides of the upper bearing member 42 to create gaps between the bearing member 42 and housing 12 as shown in FIG. 3 (or alternatively holes in bearing member 42). The through ports 244 may be angularly spaced relative to the motor housing outlets 240. Upon passing through the upper bearing member 42, the low pressure refrigerant finally enters the intake area 124 of the scroll compressor bodies 110, 112. From the intake area 124, the lower pressure refrigerant finally enters the scroll ribs 114, 118 on opposite sides (one intake on each side of the fixed scroll compressor body) and is progressively compressed through chambers 122 to where it reaches it maximum compressed state at the compression outlet 126 where it subsequently passes through the check valve 220 and into the high pressure chamber 180. From there, high pressure compressed refrigerant may then pass from the scroll compressor assembly 10 through the refrigerant housing outlet port 20.

Figure 5:
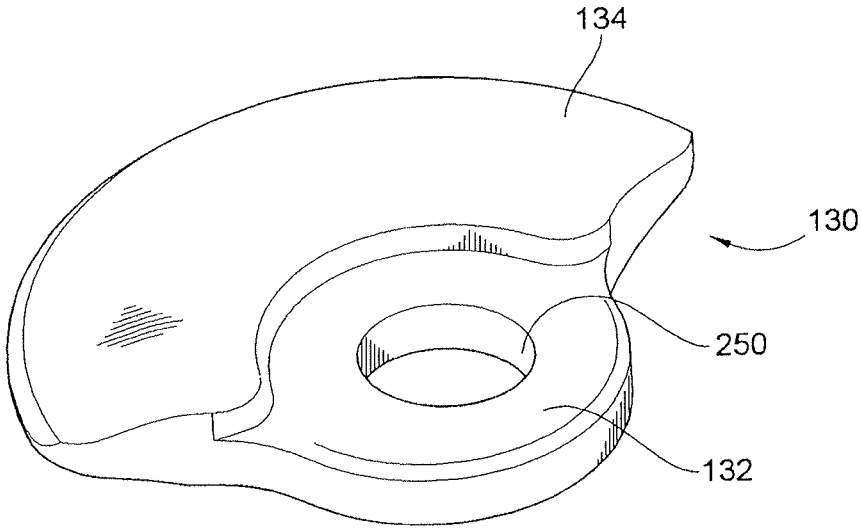
FIGS. 5 and 6 are isometric views of a counterweight component used in the scroll compressor assembly of prior figures, with FIG. 5 showing the upper side and FIG. 6 being flipped to show the underside.
Figure 6:
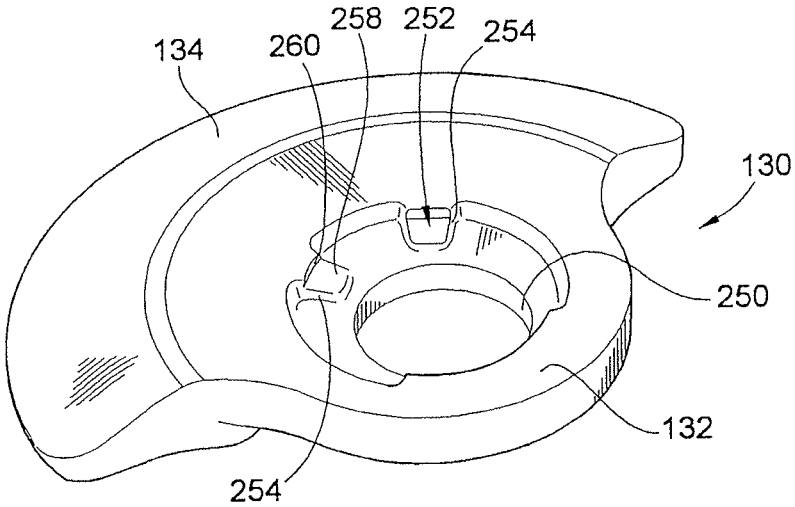
Figure 7:
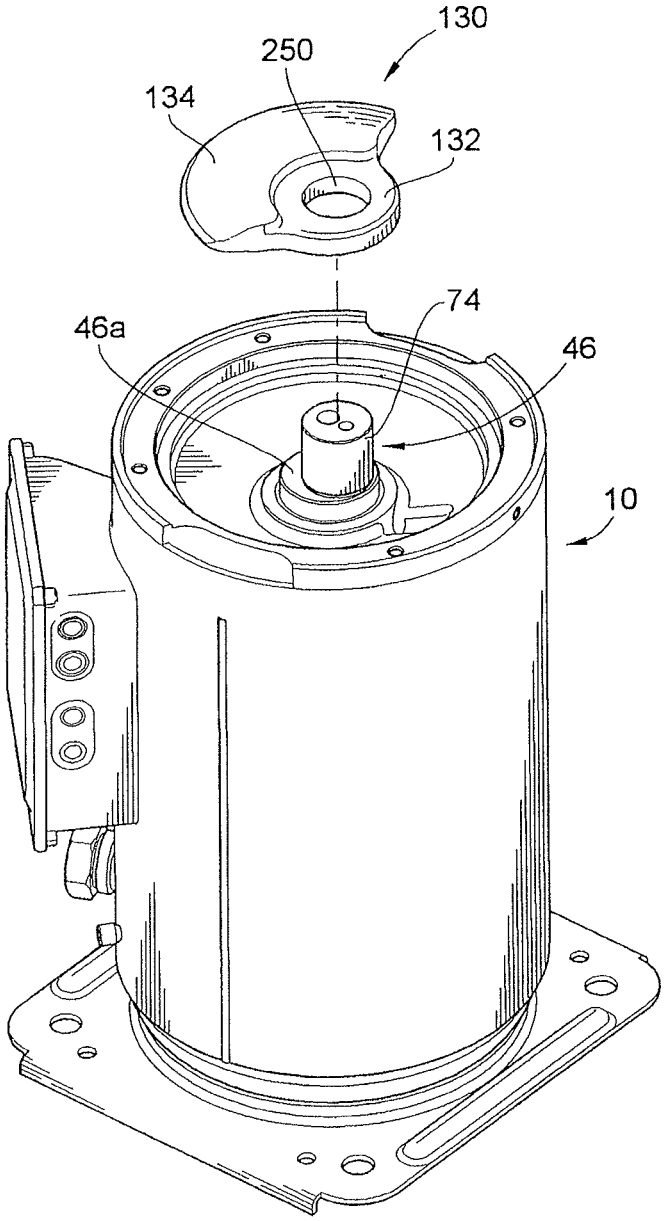
FIG. 7 is an exploded isometric view of a lower part of a scroll compressor assembly and the counterweight to illustrate how the counterweight can be mounted upon the drive shaft.

Turning to FIGS. 5-6, the counterweight 130 is illustrated in further detail, with the mounting of the counterweight to the drive shaft shown in FIG. 7. As shown in FIG. 7, the counterweight 130 is mounted by placing and sliding the counterweight 130 axially upon the top end of the drive shaft 46. As will be explained further below, this is done utilizing thermal differentiation and typically by thermally expanding the counterweight via heat and then allowing the counterweight to shrink fit upon the drive shaft. However, it will be appreciated that other forms of thermal differentiation can be used including cooling the drive shaft, for example, to reduce diameters of the drive shaft temporarily to facilitate assembly of the counterweight and/or a combination of thermal and cooling techniques. Alternatively, in another embodiment it is also possible that the counterweight may be pressed onto the shaft without benefit of thermal differentiation. While substantial axial pressing force can be used instead of thermal differentiation, thermal differentiation is a more preferred embodiment so as to avoid the need for such pressing force. While FIG. 7 illustrates that the counterweight is assembled after mounting the upper bearing member in the lower part of the bearing housing as is preferable in the present embodiment, it may also be possible to preassemble the counterweight and the drive shaft prior to assembly of some or all other components.

In accordance with certain inventive aspects, the counterweight 130 is shrunk onto one section of the drive shaft and located off of another section of the drive shaft. For example, in the illustrated embodiment, the attachment collar 132 of the counterweight 130 includes a central through hole 250 that is shrunk and thereby mounted onto the eccentric offset drive section 74 of the drive shaft 46. Furthermore, the attachment collar 132 also defines an at least partial counter bore 252 that provides for locating the offset weight region 134 at a predetermined angular position relative to the drive shaft 46 about the central axis 54 (e.g. at a predetermined angular position relative to the eccentric offset drive section 74). Alternatively, the counterweight can be shrunk fit onto the large cylindrical section **46*a* of the drive shaft 46 and located off of the eccentric offset drive section 74**. In either event, one engagement provides for shrink fit mounting while the other provides for location at a predetermined angular position.

Figure 8:
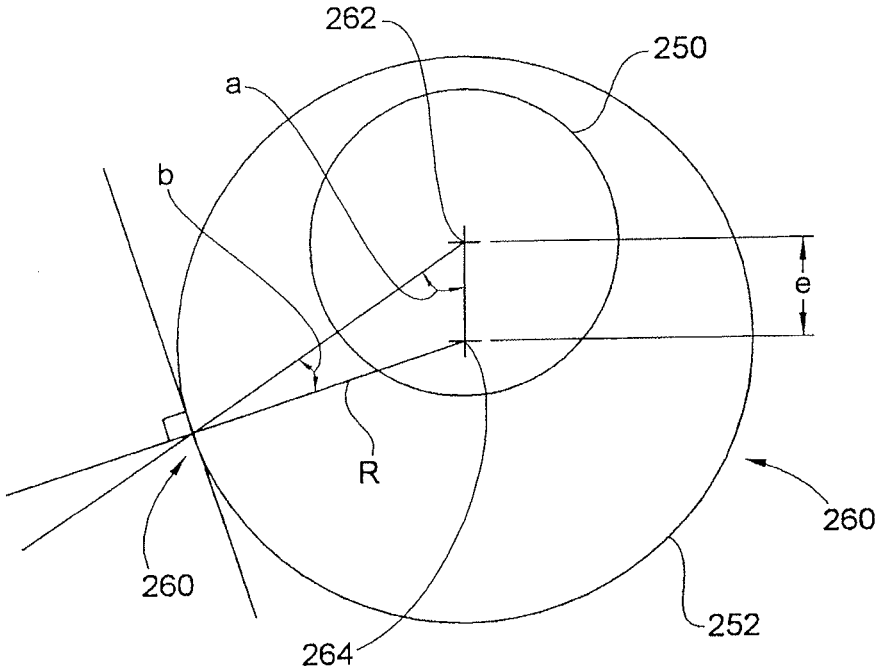
FIGS. 8 and 9 illustrate the geometric location and placement of location contact points for achieving best tolerances in relation to two embodiments including one where the counterweight is shrunk on the smaller diameter and located off the larger diameter and another where it is shrunk on the larger diameter and located off of the smaller diameter.

As is illustrated, the at least partial counter bore 252 may be an interrupted counter bore or in an alternative embodiment a fully formed counter bore. To provide for only a partial counter bore, the preferred embodiment employs at least two tabs into which the at least partial counter bore 252 can be formed. Stepped seats are thereby formed into the tabs 254 which provide an axial abutment 258 and a cylindrical wall segment 260. In the illustrated embodiment, the cylindrical wall segment 260 provides for location of the counterweight 130 at a predetermined angular position relative to the central axis 54. This is also represented in FIG. 8 in which this eccentric relationship is illustrated in which geometry is further illustrated which can be used to minimize tolerance sensitivity of the angular location of shaft location contact surfaces. In FIG. 8, the center 262 of the through hole 250 is illustrated as is the center 264 of the larger at least partial counter bore 252. The larger diameter center 264 can coincide with the central axis 54 as illustrated.

As can be realized from the foregoing, both the through hole 250 and the at least partial counter bore 252 can have circular configurations. The through hole 250, for example, may be a cylindrical opening. Each of the through hole 250 and the at least partial counter bore 252 provide separate shaft contact surfaces for either locating or thermally interfering and mounting with a different surface of the shaft. As a result, two different contact surfaces defined about different axes for coacting with the shaft are provided in which each of the axes or centers 262, 264 are located in different locations as illustrated. The centers 262, 264 are offset by a distance identified at "e" which also happens to correspond to the distance between the central axis 54 and the center of the offset drive section 74 (see previous figures).

In the case of FIG. 8 where the counterweight is located off of the larger diameter (e.g. provided by the at least partial counter bore 252 defined by location tabs 254), the location contact surfaces provided by the cylindrical wall segments 260 can be positioned in a predetermined angular position that generally minimizes tolerance sensitivity as calculated by maximizing the angle "b". Trigonometry may be used to calculate the same.

Figure 9:
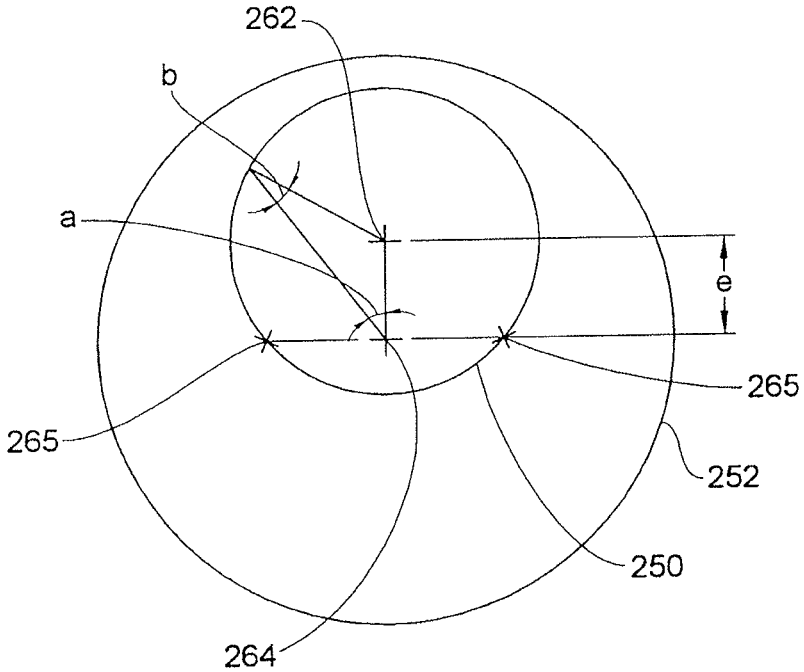

In the event that the reverse is true, as shown in FIG. 9, where the counterweight is shrunk on the larger diameter and located off of the smaller diameter, tolerance sensitivity is minimized by locating on the smaller diameter at locations along the line that passes through the larger diameter center 264 perpendicular to the separation distance E between centers (e.g. at locations 265).

By minimizing tolerance sensitivity, the center of mass of the counterweight 130 (e.g. provided by offset weight section 134) can be precisely located at so as to maximize the balancing of the overall rotational body within the scroll compressor assembly during operation. Maximizing balancing has the effect of reducing vibration and noise of the overall assembly by cancelling out the initial forces.

One advantage of the foregoing is that it provides a readily repeatable methodology for accurately mounting a counterweight while at the same time providing for simplistic assembly that can be accomplished without the necessitating fixtures or measurement instruments. Such methodology can comprise thermally differentiating a shaft in a counterweight (e.g. by heating the counterweight, for example) to facilitate assembly of the counterweight onto a drive shaft. For example, the counterweight can be heated to an elevated temperature so as to expand the through hole 250 so that it fits easily upon the offset eccentric drive section 74 of the drive shaft 46. Thereafter the counterweight is assembled with the shaft which the different contact regions of the counterweight come into engagement with different annular segments of the drive shaft. Specifically, the through hole 250 slides onto the offset drive section 74 while the at least partial counter bore 252 slides onto and over the large diameter drive shaft section 46*a*. Thereafter, the heat can be allowed to dissipate, thereby relieving the thermal differentiation to lock the counterweight onto the drive shaft. As the thermal differentiation is being relieved, self alignment can occur in that slide offsets can be corrected as the thermal differentiation is elevated. This may, in part, be automatic as the counterweight 130 wants to naturally find the position of least stress at the location surfaces provided by cylindrical wall segments 260 engaged upon the drive shaft.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A scroll compressor for compressing fluid, comprising, scroll compressor bodies having respective bases and respective scroll ribs that project from the respective bases and which mutually engage;

a drive unit providing a rotational output on a shaft, the shaft operatively driving one of the scroll compressor bodies to facilitate relative movement for the compression of fluid; and a counterweight mounted to the shaft, the counterweight having a first shaft contact surface defined about a first axis coacting with the shaft, and a second shaft contact surface defined about a second axis different than the first axis coacting with the shaft;

wherein the counterweight further includes an opening with an at least partial counterbore, which includes one of the first and second shaft contact surfaces, and which operates to locate the counterweight at a predetermined angular location about a circumference of the shaft;

wherein one of the first and second shaft contact surfaces locates the counterweight at a predetermined angular position relative to the shaft, and wherein the other of the first and second shaft contact surfaces forms an interference fit securing the counterweight to the shaft; and wherein the counterweight further includes a collar portion, and a weighted portion providing an offset center of mass, wherein the collar portion includes the opening and the at least partial counter bore for providing the first and second contact surfaces.

2. The scroll compressor of claim 1, wherein the first shaft contact surface is defined by the opening forming the interference fit, and wherein the second shaft contact surface is defined by the at least partial counter bore locating the counterweight at the predetermined angular position.

3. A scroll compressor for compressing fluid, comprising, scroll compressor bodies having respective bases and respective scroll ribs that project from the respective bases and which mutually engage;

a drive unit providing a rotational output on a shaft, the shaft operatively driving one of the scroll compressor bodies to facilitate relative movement for the compression of fluid; and a counterweight mounted to the shaft, the counterweight having a first shaft contact surface defined about a first axis coacting with the shaft, and a second shaft contact surface defined about a second axis different than the first axis coacting with the shaft;

wherein the counterweight further includes an opening with an at least partial counterbore, which includes one of the first and second shaft contact surfaces, and which operates to locate the counterweight at a predetermined angular location about a circumference of the shaft; and wherein one of the contact surfaces is formed onto two angularly spaced tabs, each spaced tab defining a partial cylindrical wall segment that engages the shaft to locate the counterweight upon the shaft.

4. An apparatus, comprising:

a shaft rotatable about a central axis, the shaft having a central annular segment generally concentric about the central axis and an eccentric annular segment offset from the central axis, wherein the eccentric annular segment includes a drive bush configured to directly engage a drive hub of a scroll compressor body to effect the rotation thereof; and a counterweight located on the drive bush engaging the eccentric annular segment and engaging the central annular segment for location and mounting of the counterweight to the shaft, the counterweight having means for locating at a predetermined angular position about the circumference of the shaft.

5. The apparatus of claim 4, wherein the counterweight includes a collar portion, and weighted portion providing an offset center of mass, wherein the collar portion includes an opening with an at least partial counter bore, wherein the at least partial counterbore seats against the central annular segment, and wherein the eccentric annular segment projects through the opening.

6. The apparatus of claim 5, wherein the opening locates the counterweight at the predetermined angular position, and wherein the at least partial counter bore has an interference fit with the eccentric annular segment.

7. The apparatus of claim 5, wherein the at least partial counter bore locates the counterweight at the predetermined angular position, and wherein the opening has an interference fit with the eccentric annular segment.

8. The apparatus of claim 4, further comprising:

scroll compressor bodies having respective bases and respective scroll ribs that project from the respective bases and which mutually engage; and a drive unit providing a rotational output on a shaft, the shaft operatively driving one of the scroll compressor bodies to facilitate relative movement for the compression of fluid.

9. The apparatus of claim 4, wherein the counterweight is configured to be mounted onto the shaft by thermally differentiating the counterweight and the shaft.

10. A method of mounting a counterweight to a shaft in a scroll compressor assembly, comprising:

thermally differentiating a shaft and a counterweight to facilitate assembly, the shaft having annular segments including a central annular segment generally concentric about a central axis and an eccentric annular segment offset from the central axis;

assembling the counterweight with the shaft, the counterweight having an opening with an at least partial counterbore;

locating the counterweight on a first one of the annular segments;

locking the counterweight on a second one of the annular segments;

wherein said locating comprising angularly locating a center of mass of the counterweight relative to the central axis;

further comprising minimizing tolerance sensitivity of said angularly locating by contacting between the counterweight and the drive shaft at two predetermined contact locations; and further comprising forming two tabs at angularly spaced locations to provide for said contact locations.

* * * * *